US009982880B2

(12) United States Patent
Tseng

(10) Patent No.: US 9,982,880 B2
(45) Date of Patent: May 29, 2018

(54) TABLE LAMP WITH EMERGENCY ESCAPE FUNCTION

(71) Applicant: Kun-Fu Tseng, Gongguan Township, Miaoli County (TW)

(72) Inventor: Kun-Fu Tseng, Gongguan Township, Miaoli County (TW)

( * ) Notice: Subject to any disclaimer, the term of this patent is extended or adjusted under 35 U.S.C. 154(b) by 342 days.

(21) Appl. No.: 14/862,631

(22) Filed: Sep. 23, 2015

(65) Prior Publication Data

US 2017/0082281 A1 Mar. 23, 2017

(51) Int. Cl.

| | |
|---|---|
| ***F21V 33/00*** | (2006.01) |
| ***F21S 6/00*** | (2006.01) |
| ***F21L 4/00*** | (2006.01) |
| ***F21V 1/12*** | (2006.01) |
| ***F21V 1/14*** | (2006.01) |
| ***F21V 1/22*** | (2006.01) |

(52) U.S. Cl.

CPC ..... *F21V 33/0076* (2013.01); *F21L 4/00* (2013.01); *F21S 6/002* (2013.01); *F21V 1/12* (2013.01); *F21V 1/143* (2013.01); *F21V 1/22* (2013.01)

(58) Field of Classification Search

CPC .... F21L 4/08; F21S 6/002; F21S 9/022; F21S 9/024; F21V 1/143; F21V 33/0064; F21V 33/0076

See application file for complete search history.

(56) References Cited

U.S. PATENT DOCUMENTS 4,090,178 A * 5/1978 Norris ..... F21V 33/0076 340/506
5,146,636 A * 9/1992 De La Pena ..... A62B 17/04 128/201.25
5,452,712 A * 9/1995 Richardson ..... A62B 17/04 128/201.22
6,729,747 B1 * 5/2004 Wirayani ..... F21V 1/12 362/355

(Continued)

FOREIGN PATENT DOCUMENTS

TW M478110 U * 5/2014 ..... F21V 33/00

OTHER PUBLICATIONS

Machine Translation of TW 478110 U.*

*Primary Examiner* — Robert May
*Assistant Examiner* — Leah S Macchiarolo
(74) *Attorney, Agent, or Firm* — Muncy, Geissler, Olds & Lowe, P.C.

(57) ABSTRACT

A table lamp with emergency escape function is provided to include a holder having a depositing part for putting a high temperature safety glove and a space part for depositing a printed circuit board; an arm fixedly deposited on the holder; a frame mounted onto the arm; a lighting module held on the arm and fixed by the frame; and a smoke lampshade having an opening and covering onto the frame to shade light source of the lighting module. User may quickly and conveniently catch the smoke lampshade, the high temperature safety glove, and utilize the lighting module as a lighting device. The printed circuit board is equipped with a sensing module and a blue tooth device, the sensing module detects surrounding environment where the table lamp is putted, and the blue tooth device transmits unusual signal detected by the sensing module to an outside signal receiving device.

13 Claims, 6 Drawing Sheets

(56) References Cited

U.S. PATENT DOCUMENTS

| | | | | |
|---|---|---|---|---|
| 7,878,678 | B1 * | 2/2011 | Stamatatos | B60Q 1/2611 116/63 P |
| 2013/0334881 | A1 * | 12/2013 | Jones | H02J 4/00 307/23 |

* cited by examiner

TABLE LAMP WITH EMERGENCY ESCAPE FUNCTION

FIELD OF THE INVENTION

The present invention relates to a table lamp, particularly relates to a table lamp capable of being emergency escape device in a fire.

BACKGROUND OF THE INVENTION

With raising consciousness of disaster prevention presently, people are concerned more and more about how to prevent happening of a disaster in advance and how to effectively protect their family and themselves once a disaster happens. Emergency response on fire disaster is the most emphasized for modern people in various kinds of disasters.

Traditional emergency response to fire disaster in restaurant or house is to prepare fire extinguisher for fire fighting or smoke helmet for preventing people from inhalational injury by dense smoke in a fire. However, on one side, even staying in a familiar environment, such as in house, usually people would not quickly reach to smoke helmet in a fire accident that usually happens at night to rouse people from sleeping and usually causes poor sight by dense smoke or malfunction of wall power. On the other side, even people quickly catch smoke helmet, they usually overstrain not to immediately successfully wear the smoke helmets because the smoke helmets are packaged by tight folding ways. In such situation that people are not protected by any way, people are greatly possibly hurt by high temperature or intake of dense smoke in a fire.

Accordingly, it is an important issue for emergency response to fire disaster to prepare convenient smoke helmets for people to quickly reach to and wear them once a fire happens during people are sleeping. It is also an important issue for smoke helmets to provide people good sight in a fire. Moreover, how to enhance surviving chances of people is also a key issue for emergency response to fire accidents. In-time detection of unusual signal cooperated with active transmission of unusual signal to associated people or in-schedule contact targets would be considered for emergency response to fire accidents to enhance surviving chances. For example, devoted to the integration of sensing device and communication device will be considered to acquire unusual signal by detection of sensing device and bi-directionally transmitting unusual signal by communication device, such as a blue tooth device, between a fire scene and outside alarm or rescue units, such as fire alarming system of building, fire center, wireless transmission devices.

Table lamp is a usual lighting device in house or restaurant and its position in house or restaurant is usually familiar to people. Accordingly, how to integrate emergency escape tools with table lamp to help people survive in fire accident and fire scene and in-time dealing with fire accident is worthy to develop.

SUMMARY OF THE INVENTION

Accordingly, one of objectives of the present invention provides a table lamp with emergency escape function which may prevent people in a fire from being dump, provide people's hands efficient protection, maintain people good sight by lighting device, and initiatively transmit fire signal to outside for enhancement of life surviving.

Accordingly, one of objectives of the present invention provides a table lamp with emergency escape function. It is convenient for people to quickly catch a smoke lampshade, a high-temperature glove and a lighting device to protect people's safety when a fire accident happens. The chance of life surviving are raised by utilization of a sensing device and a blue tooth device to detect environment by the sensing device and transmit unusual signal by the blue tooth device to an outside signal receiving device, such as fire alarm systems of a building, fire center, or wireless transmission device. Thus, associated people will be notified by the unusual signal to immediate deal with the fire accident.

Accordingly, a table lamp with emergency escape function includes: a holder, a lighting module, an arm, a frame, a power supply module and a smoke lampshade. The holder has a depositing part for putting a high temperature safety glove and a space part for depositing a printed circuit board. The arm is fixedly deposited on the holder and the frame is mounted onto the arm. The lighting module has a light source and is fixed by the frame. The power supply module is electrically coupled with the printed circuit board of the holder and the lighting module and configured to provide the lighting module power. The smoke lampshade has an opening and covering onto the frame to shade the light source of the lighting module and concentrate light. With a sensing module and a blue tooth device of the printed circuit board, the sensing module detects surrounding environment and the blue tooth device transmits unusual signal detected by the sensing module to an outside signal receiving device, which protect user's life in a fire and help user escape from the fire.

Preferably, the sensing module is equipped with a sensor of smoke detection and alarm that detects smoke in a fire or an electric fire and emits unusual signal.

Preferably, the sensing module is equipped with a sensor of temperature detection that detects high temperature in a fire or an electric fire and emits unusual signal.

Preferably, the lighting module further comprises a charging battery to supply power to the light source in case normal electric power supply fails.

Preferably, the lighting module is able to be separated from the arm and the frame to form a separated lighting device as a flashlight for user.

Preferably, the light source comprises a light emitting diode with advantages of saving power and long life.

Preferably, the smoke lampshade comprises a part of transparent mask to provide user with viewing window to see outside and observe surroundings.

Preferably, a supporting member is between the opening and the other side opposite to the opening on the smoke lampshade to prevent user wearing the smoke lampshade from poor viewing range by creases on the smoke lampshade.

Preferably, the supporting member is made of elastic material to be adjusted a suitable shape by user.

Preferably, the smoke lampshade comprises an elastic mask to tightly seal around user's head to prevent the user's mouth and nose from intake of smoke.

Preferably, the smoke lampshade further comprises a pulling rope around the opening to closing the opening to prevent the user's mouth and nose from intake of smoke.

Preferably, the smoke lampshade is made of polyimide film material of heat-proof and high-temperature resistant properties.

Preferably, the smoke lampshade further comprises a filter film that is configured for user's breathe and filtrates harmful gases and prevent the user's mouth and nose from intake of smoke.

Preferably, the filter film has compositions consisted of an oxidized fiber cloth with active carbon filtering layer and reactive active carbon fiber cloth.

Preferably, the filter film has a protective sealing membrane to protect the filter film from being damp or polluted that reduces use effect and life.

Preferably, the depositing part is a drawer and accessible by opening or closing the drawer so as to put the high temperature safety glove or other spare parts for emergency use.

DETAILED DESCRIPTION OF THE PREFERRED EMBODIMENT

The above objects, technical features and advantages of the present invention will become more readily apparent to those ordinarily skilled in the art after reviewing the following detailed description and accompanying drawings. The following more detailed description of the embodiments of apparatus and methods in accordance with the present disclosure, as represented in the Figures, is not intended to limit the scope of the disclosure. The presently described embodiments will be understood by reference to the drawings, and the drawings are not necessarily to scale. This invention is not limited to the particular embodiments disclosed, but it is intended to cover modifications within the spirit and scope of the present invention as defined by the appended claims.

The embodiments of the table lamp with emergency escape function of the present invention will be illustrated by reference to the drawings. For clear understanding, same elements will be marked as identical numerals.

Figure 1:
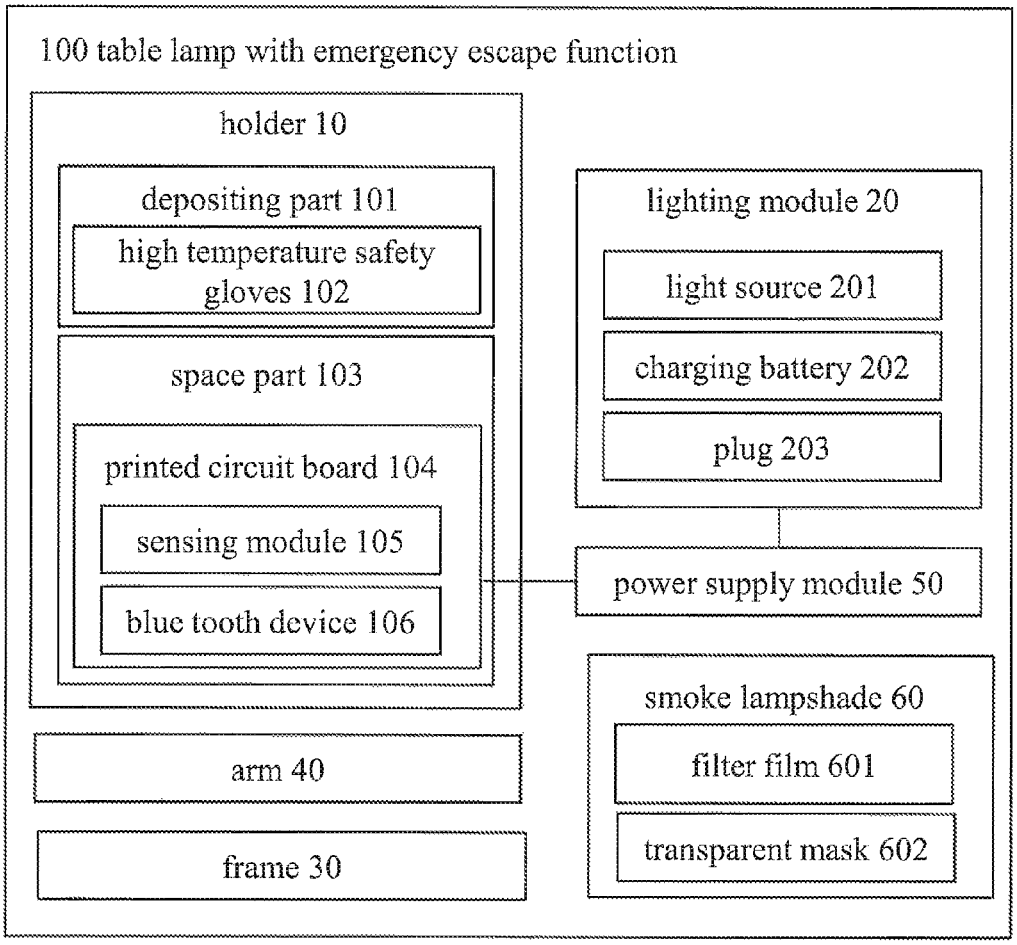
FIG. 1 is a schematic block diagram illustrating a table lamp with emergency escape function according to the present invention.
Figure 2:
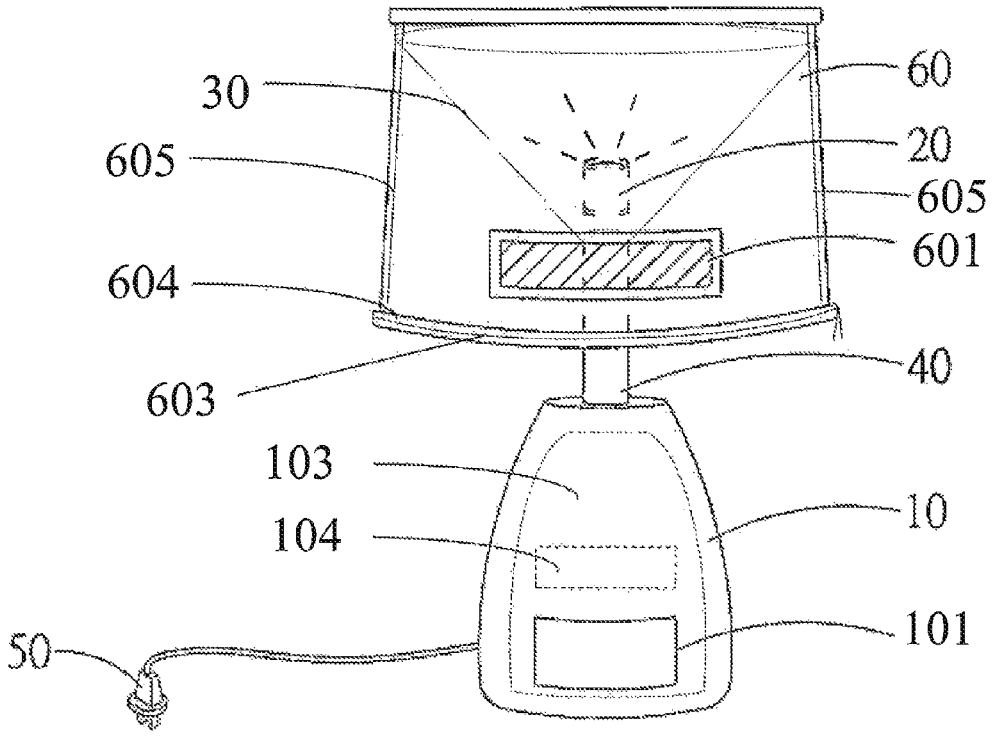
FIG. 2 is a schematic diagram illustrating a first embodiment of table lamp with emergency escape function according to the present invention.

FIG. 1 is a schematic block diagram illustrating a table lamp with emergency escape function according to the present invention. FIG. 2 is a schematic diagram illustrating a first embodiment of table lamp with emergency escape function according to the present invention. Shown on FIG. 1 and FIG. 2, a table lamp with emergency escape function 100 includes a holder 10, a lighting module 20, a frame 30, an arm 40, a power supply module 50 and a smoke lampshade 60.

The holder 10 provides a depositing part 101 and a space part 103. The depositing part 101 may be configured for putting one or a pair of high temperature safety gloves 102 or other spare parts for emergency use. In one embodiment, the depositing part 101 may be a drawer and accessed by opening or closing the drawer. The space part 103 may be configured to deposit a printed circuit board 104. The printed circuit board 104 is at least equipped with a sensing module 105 and a blue tooth device 106. The sensing module 105 is a sensor with at least with temperature detection function or smoke detection and alarm function. The blue tooth device 106 may bi-directionally communicates with an in-time fire alarm system where the table lamp is deposited after matching with the in-time fire alarm system. In the case, the blue tooth device 106 may alarm once receiving alarm message of the in-time fire alarm system or alarm according to a detection result of surrounding environment. Moreover, the blue tooth device 106 also may in time output alarm to an on-schedule contact target.

Figure 3:
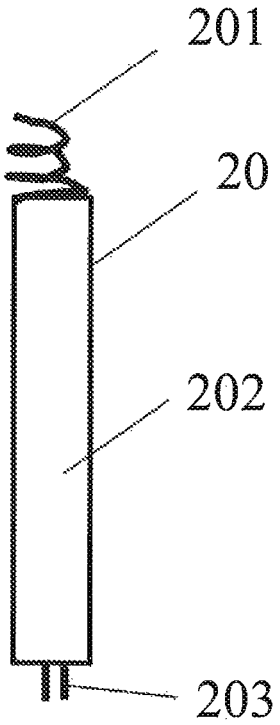
FIG. 3 is a schematic diagram illustrating a preferred embodiment of the lighting module of the table lamp with emergency escape function according to the present invention.

Next, the lighting module 20 includes a light source 201, such as a LED light popular with advantages of saving power and long life. Furthermore, the lighting module 20 further includes a charging battery 202 to supply power to the light source 201 in case normal electric power supply fails. FIG. 3 is a schematic diagram illustrating a preferred embodiment of the lighting module 20 according to the present invention. Shown on FIG. 3, the light source 201 and the charging battery 202 may be integrated together to become a single body. The other end of the lighting module 20 opposite to the light source 201 may be equipped with a plug 203, and the plug 203 is electrically coupled to the printed circuit board 104.

Next, the arm 40 may be fixedly deposited on the holder 10 and configured to hold the lighting module 20. The frame 30 may be mounted onto the arm 40 and configured to fix the lighting module 20. Furthermore, the power supply module 50 may be electrically coupled with the printed circuit board 104 of the holder 10 and the lighting module 20. It is understood that the lighting module 20 may be separated from the arm 40 and the frame 30 to form a separated lighting device.

Next, the smoke lampshade 60 has an opening 603 and covers onto the frame 30 to shade the light source 201 of the lighting module 20 and make light concentrate. In one embodiment, the smoke lampshade 60 is made of polyimide film material, which is of heat-proof and high-temperature resistant properties. The first preferred example of the smoke lampshade 60 includes an elastic mask to tightly seal around a user's head and to prevent the user's nose and mouth from dense smoke. The second preferred example of the smoke lampshade 60 includes a part of transparent mask 602 to provide the user with viewing window to see outside and observe surroundings, when the user wears the smoke lampshade 60 to cover his/her head. The third preferred example of the smoke lampshade 60 is further equipped with a supporting member 605 between the opening 603 and the other side opposite to the opening 603 of the smoke lampshade 60. The supporting member 605 may prevent the user wearing the smoke lampshade 60 from poor viewing range by creases on the smoke lampshade 60. The supporting member 605 may be made of elastic material and adjusted to a suitable shape by user himself/herself. The fourth preferred example of the smoke lampshade 60 further includes a pulling rope 604 around the opening 603. By tightly pulling the pulling rope 604 to close the opening 603, the pulling rope 604 may prevent the user from intake of dense smoke.

A filter film 601 may be mounted onto the smoke lampshade 60. The filter film 601 configured for user breathing filtrates harmful gases to prevent the user's mouth and nose from intake of the harmful gases and provide the user with the filtrated air to breathe in and out. In the embodiment, the filter film 601 has main compositions consisted of an oxidized fiber cloth with active carbon filtering layer and reactive active carbon fiber cloth. Moreover, the filter film 601 has a protective sealing membrane to protect the filter film 601 from being damp or polluted that reduces use effect and life.

Figure 4:
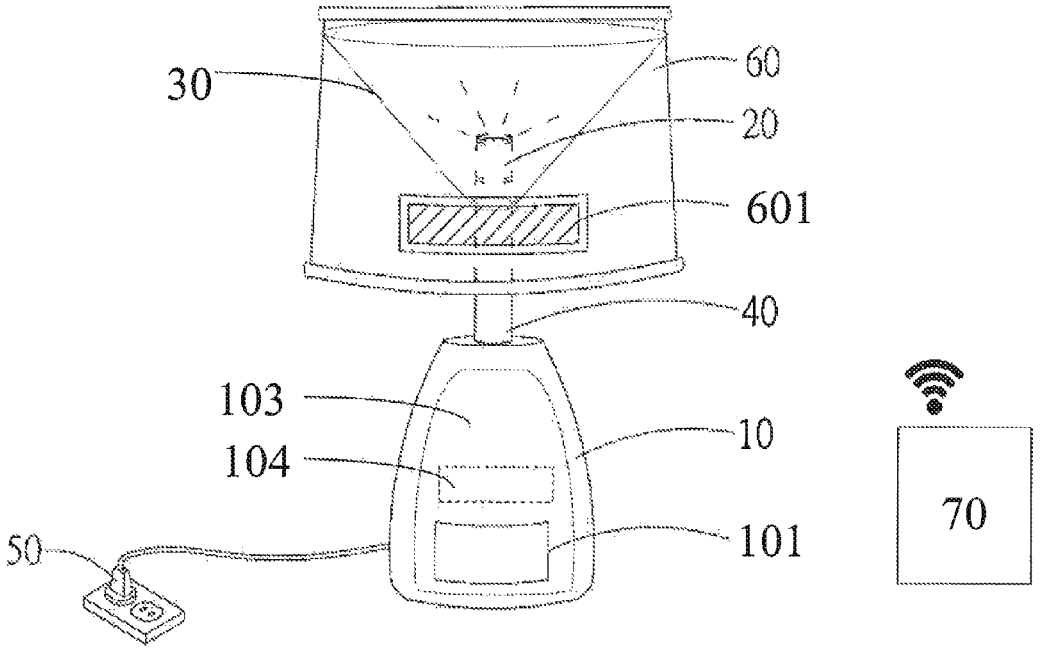
FIG. 4 is a schematic diagram illustrating a second embodiment of table lamp with emergency escape function according to the present invention.

FIG. 4 is a schematic diagram illustrating a second example of the table lamp with emergency escape function according to the present invention. Shown in FIG. 4, the table lamp with emergency escape function 100 putted within a bedroom includes the holder 10, the arm 40, the power supply module 50, the smoke lampshade 60 and the lighting module 20 covered by the smoke lampshade 60. The lighting module 20 is putted onto the arm 40 and mounted to the frame 30. The holder 10 provides the depositing part 101 to deposit the high temperature safety glove 102. The holder 10 also provides the space part 103 to deposit the printed circuit board 104. The printed circuit board 104 is at least equipped with the sensing module 105 and the blue tooth device 106. The sensing module 105 detects surrounding environment where the table lamp with emergency escape function 100 is putted, and the blue tooth device 106 transmits unusual signal detected by the sensing module 105 to an outside signal receiving device 70. Such approach may help the user in a fire scene escape from the fire scene and protect the user's safety. One sensor of the sensing module 105 includes a smoke alarm and detection device, a temperature detection device and the like sensing device, and so on. The power supply module 50, the printed circuit board 104 in the holder 10 and the lighting module 20 are electrically coupled with each another.

More illustrated, the table lamp with emergency escape function 100 is usually coupled with mains supply to provide the light source 201 of the lighting module 20 with electric power and charge the charging battery 202. Once unusual condition happens, the lighting module 20 may be separated from the arm 40 and the frame 30 to become a separated lighting device for use. The smoke detection and alarm device detects smoke in a fire or an electrical fire. The temperature detection device detects high temperature in the fire or the electrical fire to emit unusual signal. The blue tooth device 106 transmits the unusual signal from the sensing module 105 to the outside signal receiving device 70, such as a fire alarm system of a building, a fire center or wireless transmission device, and so on.

Figure 5:
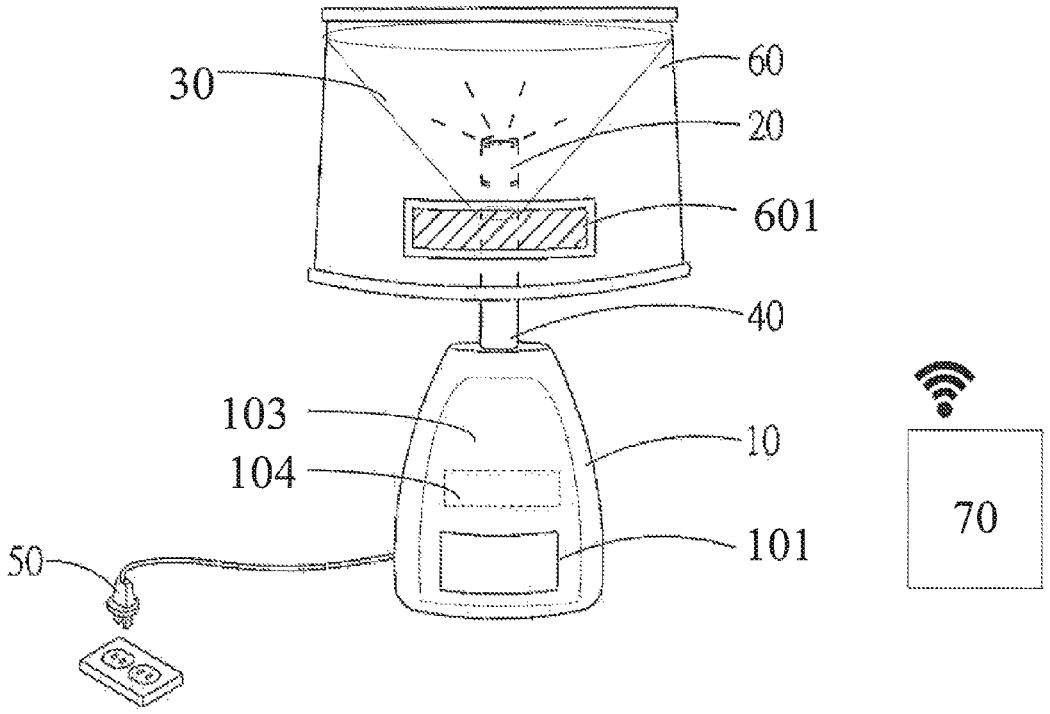
FIG. 5 is a schematic diagram illustrating a third embodiment of table lamp with emergency escape function according to the present invention.

FIG. 5 is a schematic diagram illustrating a third example of the table lamp with emergency escape function according to the present invention. Shown on FIG. 5, provided that area where the table lamp with emergency escape function 100 are putted, such as a bedroom, a restaurant or an office has a fire, the power supply module 50 can not get electric power from the wall power. In this case, the power supply module 50 will automatically switch to provide the light source 201 electric power from the charging battery 202, and the lighting module 20 may be a separated lighting device for sure user may utilize it as a flashlight in the fire scene to have good viewing.

Figure 6:
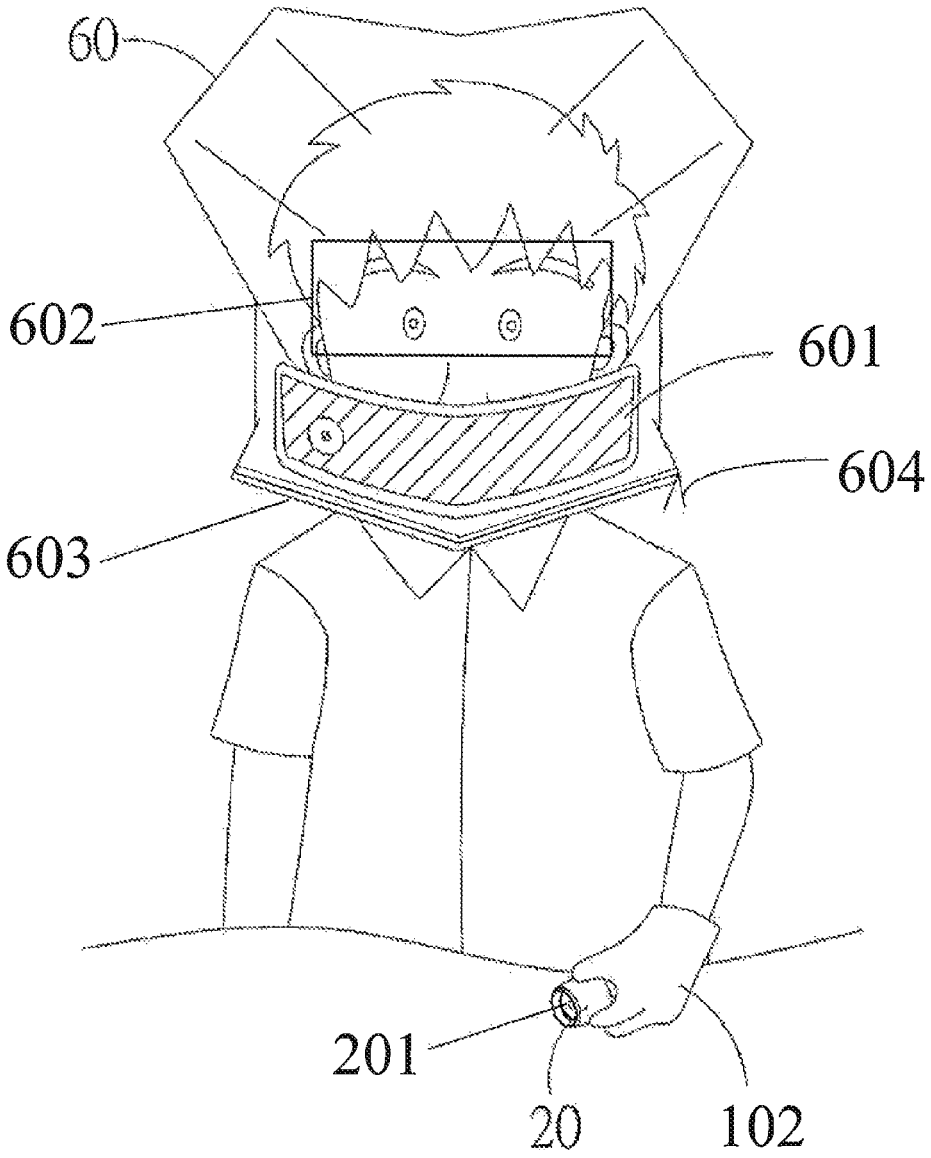
FIG. 6 is a schematic diagram illustrating a fourth embodiment of table lamp with emergency escape function according to the present invention.

FIG. 6 is a schematic diagram illustrating a fourth example of the table lamp with emergency escape function according to the present invention. Shown on FIG. 6, when the fire scene is full of dense smoke, the user can quickly wear the smoke lampshade 60 on his/her head. The smoke lampshade 60 includes the transparent mask 602 and the filter film 601. The transparent mask 602 provides the user wearing the smoke lampshade 60 a transparent window so that the user can see outside. The filter film 601 of the smoke lampshade 60 can filtrate the harmful gases so that the user may endure longer in the fire to wait for outside rescue. If there is chance for the user to escape from the fire scene, the high temperature safety glove 102 may prevent the user from directly touching high temperature matters, and the separated lighting module 20 may be used as a lighting device to help the user escape from the fire scene.

Accordingly, the table lamp with emergency escape function of the present invention may be putted in a bedroom, a restaurant or an office. Once a fire happens, user may readily pick up the table lamp with emergency escape function. Even wall power fails in a fire scene, user may utilize electric power from the battery to supply the light source and see around with the light source. Once finding a path to possibly escape out, user may move more safely in the fire scene by wearing the smoke lampshade, using the lighting device and high temperature safety glove. Furthermore, by equipping with the sensing device and the blue tooth device, the table lamp with emergency escape function may detect surrounding situation with the sensing device, and transmit unusual signal with the blue tooth device to the outside signal-receiving device, such as fire center or wireless transmission device. Consequently, the unusual signal may be automatically notified to associated people or in-schedule contact people to raise chances of saving user's life.

Accordingly, in the case of brightness or temperature of the display screen under environment changing, the image processing device with image compensation and the method thereof of the present invention may further provide the display screen with equipping brightness sensor or temperature sensor to capture the image signal by the image capturing device, determine whether great differences exist between the image parameters of the image signal and the one of the adjusted image signal or not, and re-establish 3D look up table by executing the process mentioned in the embodiments for adjustment of the image parameters if the great differences exist.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A table lamp with emergency escape function, comprising:

a holder having a depositing part for putting a high temperature safety glove and a space part for depositing a printed circuit board;

a lighting module comprising a light source;

an arm fixedly deposited on the holder and configured to hold the lighting module;

a frame mounted onto the arm and configured to fix the lighting module;

a power supply module electrically coupled with the printed circuit board of the holder and the lighting module;

a smoke lampshade having an opening and covering onto the frame to shade the light source of the lighting module; and a supporting member of an elastic material between the opening and the other side opposite to the opening on the smoke lampshade;

wherein the printed circuit board is at least equipped with a sensing module and a blue tooth device, the sensing module detects surrounding environment where the table lamp is put, and the blue tooth device transmits unusual signal detected by the sensing module to an outside signal receiving device.

2. The table lamp with emergency escape function of claim 1, wherein the sensing module is equipped with a sensor of smoke detection and alarm or a sensor of temperature detection.

3. The table lamp with emergency escape function of claim 1, wherein the lighting module further comprises a charging battery to supply power to the light source in case normal electric power supply fails.

4. The table lamp with emergency escape function of claim 1, wherein the lighting module is able to be separated from the arm and the frame to form a separated lighting device.

5. The image processing device with image compensation function of claim 1, wherein the light source comprises a light emitting diode.

6. The table lamp with emergency escape function of claim 1, wherein the smoke lampshade comprises a part of transparent mask.

7. The table lamp with emergency escape function of claim 1, wherein the smoke lampshade comprises an elastic mask to tightly seal around a user's head.

8. The table lamp with emergency escape function of claim 1, wherein the smoke lampshade further comprises a pulling rope around the opening to closing the opening.

9. The table lamp with emergency escape function of claim 1, wherein the smoke lampshade is made of polyimide film material.

10. The table lamp with emergency escape function of claim 1, wherein the smoke lampshade further comprises a filter film to filtrate harmful gases.

11. The table lamp with emergency escape function of claim 10, wherein the filter film has compositions consisted of an oxidized fiber cloth with active carbon filtering layer and reactive active carbon fiber cloth.

12. The table lamp with emergency escape function of claim 10, wherein the filter film has a protective sealing membrane.

13. The table lamp with emergency escape function of claim 1, wherein the depositing part is a drawer.

* * * * *